United States Patent [19]

Franzino

[11] Patent Number: 4,624,272

[45] Date of Patent: Nov. 25, 1986

[54] HAIR CURLING DEVICE

[75] Inventor: Peter R. Franzino, Jacksonville, Fla.

[73] Assignee: Zip Clip, Inc., Jacksonville, Fla.

[21] Appl. No.: 800,989

[22] Filed: Nov. 22, 1985

Related U.S. Application Data

[63] Continuation of Ser. No. 504,446, Jun. 15, 1983, abandoned, which is a continuation of Ser. No. 352,851, Feb. 26, 1982, abandoned.

[51] Int. Cl.[4] ..... A45D 2/00

[52] U.S. Cl. ..... 132/40; 132/33 R; 132/41 A; 132/41 B; 132/41 C; 132/46 R

[58] Field of Search ..... 132/40, 42, 33 R, 46 R, 132/48 R, 39, 41

[56] References Cited

U.S. PATENT DOCUMENTS

| | | | |
|---|---|---|---|
| 1,442,260 | 1/1923 | Fister | 132/40 UX |
| 2,510,664 | 6/1950 | Shield | 132/40 X |
| 2,841,155 | 7/1958 | Light | 132/40 |
| 3,073,318 | 1/1963 | Catania | 132/46 R |
| 3,527,237 | 9/1970 | Abe | 132/40 |

*Primary Examiner*—Gregory E. McNeill

*Attorney, Agent, or Firm*—Arthur G. Yeager

[57] ABSTRACT

A hair curling spool holder includes two mating arcuate half sections pivotally joined and with spring biased finger grips biasing the half sections closed along a longitudinal line. Each of the sections has an elongated narrow portion with a tranverse groove at each end thereof to receive and cage the flanges of a heatable cylindrical spool and a centrally located narrow transverse portion joining the elongated portion to respective finger grips. Pairs of internally projecting opposing prongs are spaced along the longitudinal line and the opposed pairs are adapted to provide frictional locking engagement with the wrapped hair and with each other to maintain the holder around the spool.

14 Claims, 3 Drawing Figures

HAIR CURLING DEVICE

This application is a continuation of Ser. No. 06/504,446, filed June 15, 1983, now abandoned, which is a continuation of Ser. No. 06/352,851, filed Feb. 26, 1982, now abandoned.

BACKGROUND OF THE INVENTION

For several years there have been sold to the public hair curling devices which involve a plurality of spools that are heated, portions of hair care are wrapped around each spool, with or without treatment lotions being applied to the hair, and the spool and hair are held in place until the curling is completed. The devices of the past have suffered from one or more of several deficiencies which have caused problems of various sorts in the use of these devices. In some instances a U-shaped clip, or the like, which encircles the spool after hair has been rolled onto the spool has been made of metal which transmits heat readily from the spool to the scalp of the user causing a burn or an uncomfortable burning sensation. In other instances a U-shaped clip, or the like, is improperly designed to remain in place for the necessary period of time while the user goes about her normal daily routine involving many movements of the head which tend to loosen the roller and its attachment means. In still other instances the clips or holders, when applied to the spool, cover so much of the hair on the spool that the proper application of lotions to all of the hair is inhibited.

It is an object of this invention to provide an improved hair curling clip or holder particularly adapted for use about a heated spool. It is another object of this invention to provide an improved hair curling spool holder that does not permit slippage of the spool and the hair on the spool once it has been arranged. It is still another object of this invention to provide an improved hair curling spool holder that eliminates damage to the hair and burning of the scalp. It is still another object of this invention to provide an improved hair curling spool holder that provides increased access to the hair wound on the spool for proper application of hair treatment lotions. Still other objects will be apparent from the more detailed description of the invention which follow.

BRIEF DESCRIPTION OF THE INVENTION

This invention provides a hair curling holder for use on a heatable, cylindrical spool having upstanding hair engaging nibs on its outer surface and an outwardly extending flange at each end. The spool holder is adapted to be releasably attachable around the spool and includes two mating half sections pivotally joined together through spring biased fingergrips adapted to open and close the sections along a longitudinal line. Each of the sections has an elongated narrow portion generally parallel to the longitudinal axis of the spool and a centrally located narrow transverse portion joining the elongated portion to one of the fingergrips. In one aspect of the invention pairs of internally projecting opposing prongs are spaced along the longitudinal line on respective sections to provide frictional locking engagement with the hair wrapped about the spool and with each other to inhibit lateral dislodgment of the spool from the holder. In another aspect of this invention each of the mating half sections of the spool holder includes adjacent the ends thereof transverse depressions forming elongated arcuate grooves adapted to receive and cage the flanges of the spool.

BRIEF DESCRIPTION OF THE DRAWINGS

The novel features believed to be characteristic of this invention are set forth with particularity in the appended claims. The invention, itself, however, both as to its organization and method of operation, together with further objects and advantages thereof may best be understood by reference to the following description taken in connection with the accompanying drawings in which:

DETAILED DESCRIPTION OF THE INVENTION

Figure 1:
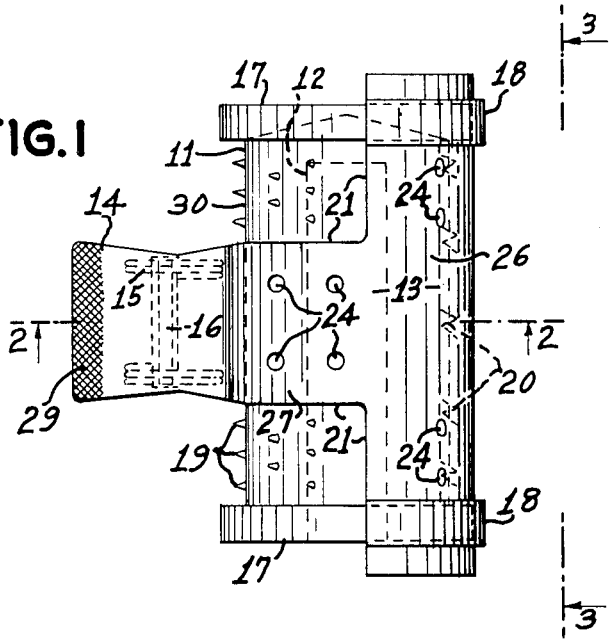
FIG. 1 is an elevational view of one side of the device of this invention.

The features of the invention can be more readily appreciated by the reference to the attached drawings. The hair curling devices available today include a spool which is heated in an electric device, removed from the heater, hair is rolled around the outside of the spool, and a U-shaped resilient clip or other device is attached to hold the spool in place until curling is accomplished, usually with the assistance of the application of a treatment lotion to the hair while the spool is hot. This invention is directed to an improved lip or spool holder that provides several advantages in its application to the hair and spool without damage thereto and to provide protection to the scalp of the user. The improved clip of this invention is applicable to and may be used on any of the several types of hot spools now available on the market.

In the attached drawings the roller or spool 11 is shown as a cylindrical device having a flange 17 at each end thereof and the outer surface 30 between flanges 17 being covered with a plurality of nibs 19 which project upwardly from such outer surface. Flange 17 is spaced apart from surface 30 by a plurality of spacer webs 31. An axial cavity 12 is available from one end of spool 11 so that the spool may be placed over a heating element and brought to the proper temperature before being used in the curling of hair. The features of spool 11 form no part of this invention and may generally be applicable to any of the several types of hot hair curling devices available today. This invention does not modify or change any of the features of the spool but applies solely to the features and design of the clip or holder which encircles the spool once it has hair rolled around its outside surface.

Figure 2:
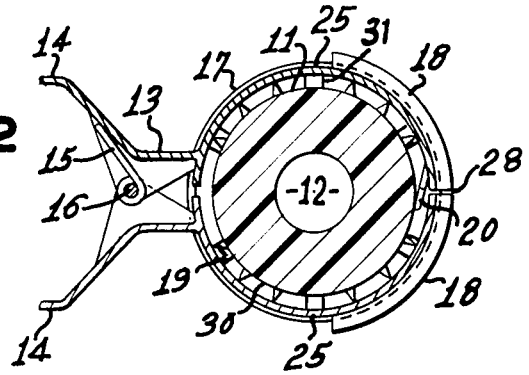
FIG. 2 is a cross sectional view taken along 2—2 of FIG. 1.
Figure 3:
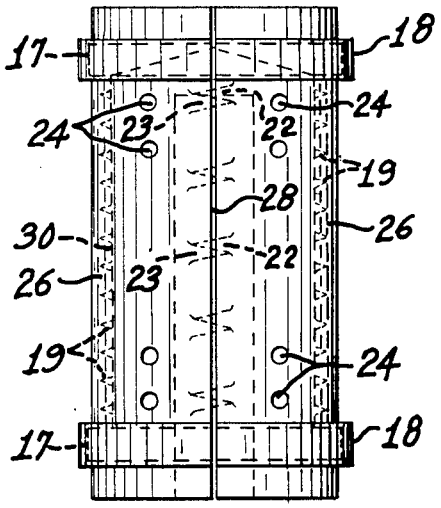
FIG. 3 is an elevational view taken in the direction of 3—3 of FIG. 1.

The clip or holder in accord with this invention is designated generally by numeral 13 and several important design features are embodied therein. One of these features is directed to shaping holder 13 so as to encircle spool 11 when the holder is closed and to be readily removed from around spool 11 when holder 13 is opened. Holder 13 comprises two substantially identical half sections 25 which are arranged and connected so as to mate with each other and form an encircling shield member around spool 11. These half sections 25 meet along a longitudinal line or edge 28 on one side and are joined together on the other side through pivot pin 16 in the vicinity of finger grips 14. The two mating half sections 25 pivot around pin 16 to open when fingergrips 14 are pressed toward each other and to permit holder 13 to be removed completely from the spool 11 and the hair wrapped therearound. When fingergrips 14 are forced apart from each other as by compression spring 15 they cause the two half sections 25 to close upon each other until they are substantially closed along edge 28 and substantially completely encircle the outside of spool 11 near the scalp of the user. A spring 15 is coiled around pivot pin 16 with opposite ends of spring 16 bearing against the inside of fingergrips 14 so as to bias the fingergrips apart and to maintain holder 13 in the normally closed position shown in FIG. 2.

Each of mating half sections 25 comprises a narrow elongated portion 26 that extends in a longitudinal direction at least sufficient to be coextensive with the length of the main body of spool 11, but including flanges 17 in the preferred embodiment. In the radial direction narrow elongated portion 26 preferably covers from about one quarter to about one sixth of the surface of spool 11 since the primary function of portions 26 when closed upon each other is to shield the hot spool from the scalp of the user. About midway of its length elongated portion 26 is joined to transverse portion 27 which in turn is connected to fingergrips 14. The width of transverse portion 27 measured in the longitudinal direction of spool 11 should be as small as possible and need not be greater than the width of fingergrips 14 measured in that same direction. It may be seen that this arrangement provides a covering for all or nearly all of spool 11 where it might come in contact with the scalp of the user and thus protects the scalp from the heat of the hot spool during the curling operation. In addition it is preferred that each half section 25 leaves as much as possible of spool 11 uncovered so that the application of hair treatment lotions to substantially all of the hair around spool 11 is facilitated. In order to provide even greater access to the hair holes 24 may be incorporated into holder 13 to the maximum extent possible while retaining sufficient strength in these portions of half sections 25 to resist breakage and to provide the heat shielding function. While it is possible for the clip of this invention to have elongated portions 26 to extend completely around the hair wrapped hot curler 11 such a construction would increase the plastic material costs and require that more holes 24 be provided throughout to permit access to the hair wrapped around the hot roller. In order to provide a better contact between fingers and fingergrips 14, the outside surface of fingergrips 14 may be roughened or ridged at 29 in a manner well known in the art.

In the preferred embodiment of this invention each of half sections 25 includes adjacent the ends thereof a grooved portion 18 adapted to receive flanges 17 of spool 11. The inclusion of such grooved portions 18 in holder 13 provides a positive means to prevent spool 11 from sliding axially and becoming disengaged from holder 13. Such occurrences have been known to occur in connection with prior art devices after the hair curling operation has taken place and while the user is involved in other activities that might shake or jar the curling devices loose.

A particularly important feature of this invention includes the provision of pairs of opposing prongs 20 on each half section 25 extending along longitudinal line 28 in spaced relationship so as to provide a frictional locking engagment with each other when the half sections 25 are closed to grip the hair wrapped around the hot spool 11. A plurality of pairs of opposed prongs (four to six pairs) per holder 13 provide the appropriate locking engagement to the hair. Each prong 20 is generally in the form of a tapered tooth extending at an angle and projecting inwardly from elongated portion 26 along longitudinal line 28. The pointed ends project beyond line 28 and the tapered portions of each opposed pair may contact each other as the half sections 25 are closed upon each other so as to provide a rubbing frictional engagement between each pair of prongs 20. These prongs 20 will engage hair on spool 11 and will substantially inhibit the axial slippage of spool 11 with respect to holders 13 and thus may permit the elimination of grooved portions 18 in some instances as when maximum scalp protection is not desired, or in other circumstances. Nevertheless it is preferred to employ both grooved portions 18 and opposed pairs of prongs 20 to maximize the effective holding power of the clip and the heat shield capabilities thereof.

The spool holders of this invention may be made of any convenient material, but it is preferable that the material be a poor conductor of heat so that it will not readily conduct the heat of spool 11 to the scalp of the user. Plastic materials of many types are suitable for this purpose including polyolefins, polyacrylics, polyamides, phenolics, and many other thermoplastic or thermosetting materials are usable.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A hair curling spool holder for releasable attachment about a heatable elongated cylindrical spool onto which hair is wrapped therearound with upstanding hair engaging nibs on its outer surface and an outwardly extending flange at each end, the improvement comprising a pair of mating half sections having a respective finger grip, each said section including an elongated narrow portion generally parallel to the longitudinal axis of an elongated spool and a centrally located narrow transverse portion joining said elongated narrow portion to its said finger grip, said half sections being pivotally joined together adjacent said finger grips adapted to open and close said narrow portions along a longitudinal line to be respectively removed from or closely encircle an elongated spool, said half sections having spaced open ends to substantially expose therethrough the ends of an elongated spool clamped therebetween, said holder having pairs of internally projecting opposing prongs spaced along said longitudinal line, said opposed pairs of prongs being connected internally of said elongated narrow portions of said sections for providing lateral locking engagement with each other to close said holder around an elongated spool and to engage the hair of a user without damage thereto.

2. The holder of claim 1 further comprising a pivot pin pivotally connecting said half sections together and a coiled spring about said pivot pin biased to force said finger grips apart and to force said half sections to a closed position.

3. The holder of claim 1 wherein each of said prongs is tapered from a generally pointed end projecting outwardly from said holder section to a wide base at the juncture of said prong with said holder section.

4. The holder of claim 1 wherein each of said half sections includes a groove adjacent each end of said elongated narrow portion adapted to receive such flanges of such spool to laterally cage such spool within said holder.

5. The holder of claim 3 wherein opposed tapered prongs are positioned to bear against each other with greater frictional engagement as said half sections close upon each other.

6. A hair curling spool holder for releasable attachment about a heatable elongated cylindrical spool onto which hair is wrapped therearound with upstanding hair engaging nibs on its outer surface and an outwardly extending end flange at each end, the improvement comprising a pair of mating curved half sections having a respective finger grip and each section including an elongated narrow portion generally parallel to the longitudinal axis of an elongated spool and a centrally located narrow transverse portion joining said elongated portion to its said finger grip, said half sections being pivotally joined together adjacent said finger grips adapted to open and close said narrow portions along a longitudinal line to be respectively removed from or closely encircle an elongated spool, said holder half sections having spaced open ends and further including an elongated depression in the inner face thereof adjacent each end of said elongated portion with said depressions adjacent each pair of ends being in substantially longitudinal alignment with each other and forming an elongated groove for receiving a respective end flange of an elongated spool to cage same against lateral movement within said holder.

7. The spool holder of claim 6 wherein said holder has pairs of internally projecting opposing prongs spaced along said longitudinal line, said opposed pairs of prongs adapted to provide lateral locking engagement with each other to close said holder around said spool and to engage the hair of a user without damage thereto.

8. The spool holder of claim 6 wherein each said mating half section is a mirror image of the other half section.

9. The spool holder of claim 6 wherein said spool includes a cylindrical flange outwardly extending from each end of the spool, and said groove engages said flange to inhibit longitudinal movement of said spool.

10. The spool holder of claim 6 wherein said mating half sections are joined to each other through a pivot pin adjacent said fingergrips, and a coiled spring about said pivot pin is adapted to bias said fingergrips apart and to close said half sections upon each other.

11. A hair curling spool holder for releasable attachment about a heatable cylindrical spool having a longitudinal axis and onto which hair is wrapped therearound with upstanding hair engaging nibs on its outer surface and an outwardly extending end flange at each end, the improvement comprising a pair of identical mating half sections each having opposite end portions, a finger grip adjacent one said end portion, each section including a body portion for encircling approximately one-half of a spool and a centrally located portion joining said body portion to its said finger grip, said half sections being pivotal along a pivotal axis adjacent said finger grips to open and close said body portions along a longitudinal line parallel to a spool longitudinal axis to be respectively removed from or closely encircle a spool, said longitudinal line being closely adjacent an outer surface of a spool, said pivotal axis being parallel to said longitudinal line and a longitudinal axis of a spool and being spaced remote from an outer surface of a spool, each said section having a plurality of spaced and projecting prongs spaced apart and along said longitudinal line, said sections when mated having said spaced prongs in interlocking relationship to provide lateral engagement therebetween to close said holder around a spool and to engage hair of a user without damage thereto whereby a spool with hair wrapped thereon is engaged by said holder and maintained in position on a head of a user, said holder when said half sections are engaged having generally round spaced open ends along longitudinal axis of a spool to substantially expose therethrough the ends of a spool clamped therebetween.

12. The holder of claim 11 further comprising spring means associated with said sections adjacent said pivotal axis for biasing said sections toward the closed positions about a spool.

13. The holder of claim 11 wherein said half section body portions extend substantially the same length as a length of a spool.

14. The holder of claim 11 wherein said holder is useable on various diameters of cylindrical spools.

* * * * *